US007034640B2

(12) United States Patent
Nguyen et al.

(10) Patent No.: US 7,034,640 B2
(45) Date of Patent: Apr. 25, 2006

(54) SUSPENDED AND TRUNCATED CO-PLANAR WAVEGUIDE

(75) Inventors: John A. Nguyen, Hayward, CA (US); Anand Gundavajhala, Cupertino, CA (US)

(73) Assignee: Oplink Communications, Inc., Fremont, CA (US)

( * ) Notice: Subject to any disclaimer, the term of this patent is extended or adjusted under 35 U.S.C. 154(b) by 0 days.

(21) Appl. No.: 10/778,013

(22) Filed: Feb. 11, 2004

(65) Prior Publication Data

US 2004/0227595 A1 Nov. 18, 2004

Related U.S. Application Data

(60) Provisional application No. 60/446,258, filed on Feb. 11, 2003.

(51) Int. Cl.
*H01P 3/08* (2006.01)

(52) U.S. Cl. ..... 333/238; 333/246

(58) Field of Classification Search ..... 333/238, 333/246

See application file for complete search history.

(56) References Cited

U.S. PATENT DOCUMENTS 5,319,329 A * 6/1994 Shiau et al. ..... 333/204

* cited by examiner

*Primary Examiner*—Benny Lee
(74) *Attorney, Agent, or Firm*—Fish & Richardson P.C.

(57) ABSTRACT

A suspended and truncated co-planar waveguide is described. The waveguide has a substrate with a substantially flat top surface and two lateral faces. A signal conductor and two ground conductors are placed on the top surface forming a ground-signal-ground pattern along a common plane. The waveguide has respective electrical side-wall boundaries on each of the two lateral faces of the substrate.

23 Claims, 5 Drawing Sheets

SUSPENDED AND TRUNCATED CO-PLANAR WAVEGUIDE

This application claims the benefit of Provisional Application No. 60/446,258, filed Feb. 11, 2003.

TECHNICAL FIELD

The present invention relates generally to electrical components.

BACKGROUND

Until the advent of Coplanar Waveguides (CPWs), microstrip line was the conventional broadband transmission medium employed for use in electronics operating at the microwave and millimeter wave frequency bands. However, the major drawback with microstrip line is the difficulty encountered in placing series and shunt components on the same surface as the microstrip signal conductor. The problem arises because the ground conductor—to which electrical contact is essential for the operation of many components—is conventionally formed on the backside of a substrate (e.g. Duroid, ceramic, etc.) on which the microstrip line is formed. Consequently, conductor-filled via holes through the substrate must be made to connect components on the topside of the substrate with the ground conductor (i.e. ground plane) on the bottom side of the substrate. The conducting material used in the via holes adds parasitics, such as unwanted inductances and resistances, to circuits assembled on the top side of the substrate. The parasitics in many cases lead to limits on the high frequency performance of the microstrip lines and circuits that include them.

CPWs, on the other hand, are better suited for high frequency and ultra broadband transmission applications since their basic structure is one in which both the signal and ground conductors lie on a same plane. Conventionally, a CPW includes a central signal conductor and two ground conductors arranged to form a Ground-Signal-Ground pattern with all three conductors lying in a same plane. The signal conductor is, of course, not physically (i.e. electrically) contacting either of the two ground conductors; however the respective spacing between the signal conductor and either of the two ground conductors is made close enough that the signal conductor is electromagnetically coupled to both ground conductors. The signal conductor and two ground conductors of a CPW are typically mounted on the flat top surface of a substrate that defines the plane of the CPW. It is not uncommon for the flat under side of the substrate to be covered by a conductive metal thus forming a Conductor-Backed CPW (CBCPW).

Ideal CPW transmission lines would have expansive substrates and ground planes. However, such a structure is impractical to construct. Accordingly, conventional substrates used have a finite thickness (and width) and each of the ground conductors must also have a finite width. Beyond these two approximations, other refinements can be made in order to tailor the performance of the CPW structure so that CPWs may be integrated into various microwave or millimeter wave circuits and assemblies (e.g. packages).

Specifically, CPWs of a wide range of impedances can be synthesized by varying the signal conductor and slot (gap) width(s). A slot width is the distance between the signal conductor and a respective ground conductor. With two degrees of freedom (signal conductor and gap widths), as compared to microstrip line which has only one degree of freedom for a given substrate thickness, CPWs can accommodate components without the added worry of compromising the CPWs characteristic impedance during assembly of a circuit. Moreover, ground return paths and connections can be kept very short for a CPW to afford good broadband high frequency performance.

The disadvantages of CPWs include the higher possibility of dominant undesired mode generation and lower power handling capability as compared to other available transmission media in the frequency bands of interest. There is especially a problem with spurious mode (i.e. unwanted electromagnetic wave modes) generation associated with broadband signal transmission on Conductor-Backed Coplanar Waveguides (CBCPW).

CBCPWs support modes which can be categorized into one of three groups: 1) transmission modes guided by the CPW slots (gaps)—of which there is usually just one known as the fundamental mode, which is utilized for the transmission of signals on the CPW; 2) parallel-plate modes guided between the CPW plane and the backside conducting plane; and 3) possible parallel-plate modes guided in the space between a cover (above the CPW plane) and the signal conductor. The third group of modes (possible parallel plate modes) is relatively less important since the cover can usually be moved far enough away from the top for CPW to avoid the unwanted effects. Of the second group, only the lowest order mode is usually present but the second group serves as a detrimental vehicle for energy leakage from the fundamental mode supported by the CPW. Leakage occurs when the phase velocity of the parasitic mode(s) is slower than the phase velocity of the fundamental mode. Generally, the leakage is a continuous function of frequency with a leakage angle that varies such that the parasitic mode phase velocity projected along the fundamental mode direction matches the fundamental mode phase velocity. In a conductor-backed CPW, the backside conductive plane parallel-plate mode is generally slower than the fundamental CPW mode (in terms of phase velocity) and thus energy leakage occurs at all frequencies.

From a time-domain perspective, wideband signals typically consist of pulses of a few picoseconds in duration that need to be transmitted with a high-fidelity pulse shape which is faithfully maintained in the transmission medium through to the receive ($R_x$) end. If the high-fidelity of the pulses is not maintained, consecutively transmitted pulses smear into one another leading to a phenomenon known as Inter-Symbol Interference (ISI). Unfortunately, currently known CPW structures do not provide much freedom of design that can be taken advantage of to significantly lower the effects of ISI.

For example, in OC768 based systems, 40 Gbps opto-electronic networks require undistorted transmission of picosecond pulses over optical and electronic transmission media. Compared to the generation and characterization of picosecond electrical pulses, which is an almost fully matured technology, the development of transmission structures capable of handling the extremely wide bandwidth of these pulses still remains difficult. For electrical pulses a few tens of picoseconds in duration, modal dispersion due to the physical dimensions (i.e. geometry) of the transmission media is the dominant factor contributing to pulse distortion.

Illustrated in FIG. 1 is a cross-sectional view of a prior art Coplanar Waveguide (CPW) structure 100. The prior art CPW structure 100 is comprised of a signal conductor 20 and ground conductors 22 and 23 spaced away from either side of the signal conductor 20 respective lateral distances $s_1$ and $s_2$. The signal conductor 20 and ground conductors 22 and 23 are all on a same plane that is defined by the top surface of the substrate 30, which rests atop a surface of a package base 50 and inherently has a dielectric constant. The surface of the package base 50 (or the entire package base 50) is conductive so that the surface of the (entire) package base 50 or the entire package base can be biased at and thus provide the ground potential for equipment in which the substrate is incorporated. Lastly, the prior CPW structure 100 may optionally include a conductive back plate 40 affixed between the bottom of the substrate 30 and the surface of the package base 50.

SUMMARY OF THE INVENTION

There is provided a transmission medium for use in broadband applications. The transmission medium include a substrate having a flat top surface and two lateral faces. A signal conductor and two ground conductors are positioned on the flat top surface of the substrate forming a ground-signal-ground pattern along a common plane, wherein the ground conductors extend to the edges of the flat top surface of the substrate, the transmission medium included. A respective electrical side-wall boundary on each of the two lateral faces of the substrate and a base defining a cavity underneath substantially the entire length of the substrate.

In some embodiments the base provides a common ground potential that is coupled to the two ground conductors and each of the two electrical side-wall boundaries. In some embodiments the base is air filled, while in others the base is filled with a dielectric material. In some embodiments the base defining the cavity comprises a plurality of conductive ribs.

In some embodiments, the transmission medium has electrical side-wall boundaries comprising conductors wrapped around the lateral faces of the substrate.

In some embodiments, the transmission medium has electrical side-wall boundaries comprising a plurality of conductive vias connecting the flat top surface of the substrate to the base.

Some embodiments include a transmission medium and a monolithic microwave or millimeter-wave integrated circuit ("MMIC"). In some of such embodiments, the MMIC has a top surface arranged to be approximately co-planar with the flat top surface of the substrate.

There is provided a method of fabricating a transmission medium. The method comprises the steps of providing a ceramic base in a pre-fired or paste state, providing a co-planar waveguide having a signal conductor and two ground conductors, arranging the co-planar waveguide on the base, removing base material from underneath the co-planar waveguide thereby creating a cavity and cofiring at least the base and the co-planar waveguide.

The details of one or more embodiments of the invention are set forth in the accompanying drawings and the description below. Other features, objects, and advantages of the invention will be apparent from the description and drawings, and from the claims.

DESCRIPTION OF THE DRAWINGS

The invention will now be described in greater detail with reference to the accompanying diagrams, in which.

DETAILED DESCRIPTION OF THE INVENTION

Figure 1:
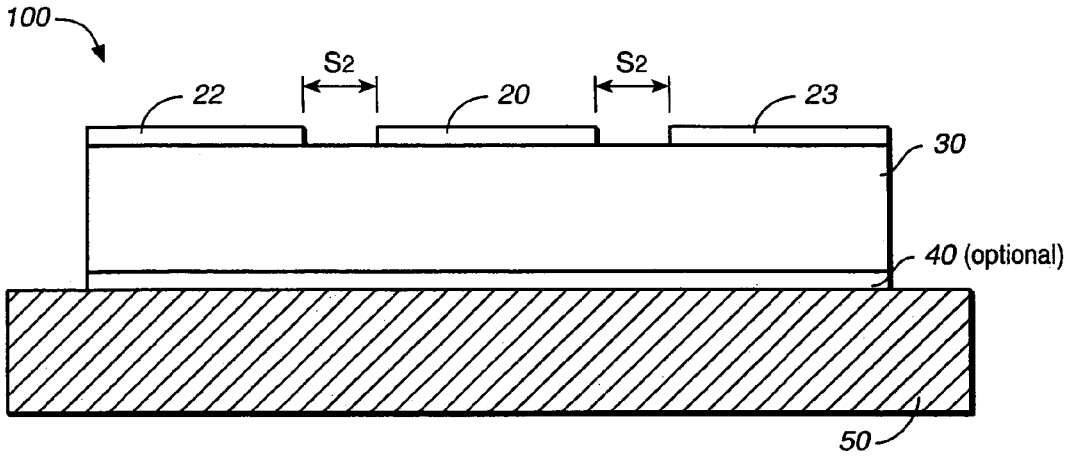
FIG. 1 (PRIOR ART)
FIG. 1 is a cross-sectional view of a prior art Coplanar Waveguide structure mounted on a package base.
Figure 2:
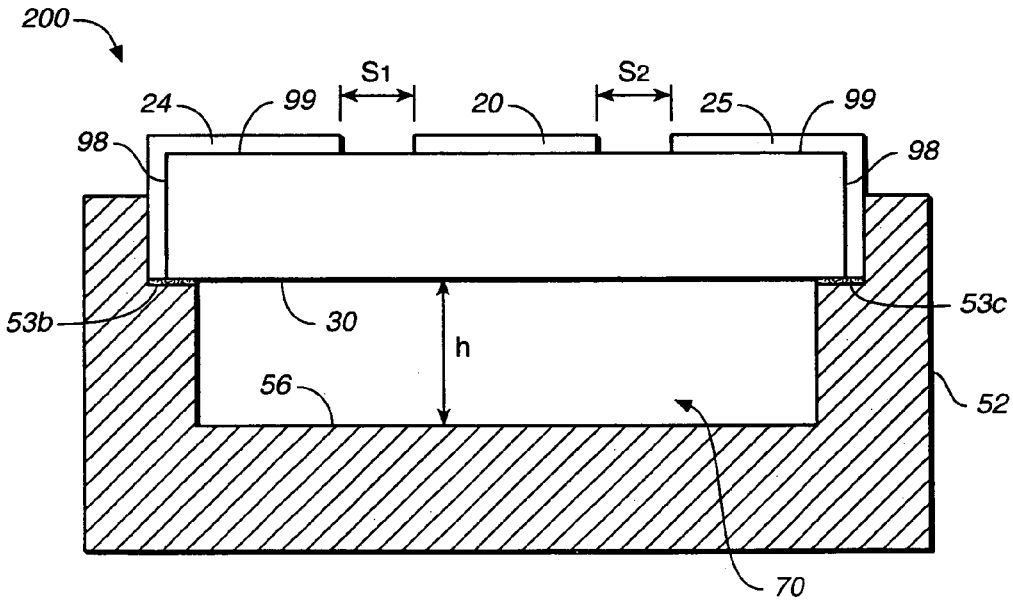
FIG. 2 is a cross-sectional view of a Coplanar Waveguide structure.

FIG. 2 shows a CPW structure 200 that includes a substrate 30 and a signal conductor 20. The CPW structure 200 has ground conductors 24 and 25 that wrap around from a top surface 99 of the substrate 30 onto the lateral faces 98 of the substrate 30. Having the ground conductors 24 and 25 extend around and over the lateral faces of the substrate provides the CPW structure 200 with an electrical side-wall boundary that acts to mitigate the effects of spurious mode generation. Suppression of spurious modes will be discussed in greater detail below.

In alternative embodiments, the lateral faces 98 of the ground conductors 24 and 25 that cover the lateral faces 98 of the substrate 30 could be replaced with electrically equivalent structures. For example, grounded castellated conductive bands (not shown) that extend along the length of the lateral faces 98 of the substrate 30 could be used to provide the electrical side-wall boundary effect. Alternatively, grounded laterally spaced conductive vias (not shown) that run top-to-bottom along the lateral faces 98 of the substrate 30 could be used for the same purpose.

In an implementation shown, ground conductors 24 and 25 electrically contact a metal package base 52 on planes parallel to the lateral faces 98 of the substrate 30. Implicitly the ground conductors 24 and 25 are biased to a same potential as the package base 52 since there is a physical connection between each of the ground conductors 24 and 25 and the package base 52. The package base 52 is further adapted to support (suspend) the substrate 30 in a position above a cavity 70. In one implementation, the cavity 70 is filled with a material having a lower dielectric constant that the substrate 30. In one implementation, the cavity 70 is filled with air. Package base 52 provides ledges 53*a*, 53*b* (or in other embodiments ribs, spaced conductive pillars or a dielectric block that runs under the length of the substrate 30) on which the substrate 30 rests. In one implementation, the cavity 70 runs substantially the entire length of the substrate 30 in the transmission direction (into or out of the cross-section) The ledges 53*a*, 53*b*, and thus the substrate, are a height h above a substantially flat surface 56 also defined by the package base 52. Package base 52 can be milled from a solid piece of material or formed from casting material in the configuration shown in FIG. 2.

The CPW structure 200 shown in FIG. 2 is referred to as a Suspended and Truncated CPW (STCPW) because: i) the substrate 30 is supported (suspended) above the cavity 70; and ii) the lateral faces 98 of the substrate 30 are treated (i.e. the ground conductors 24 and 25 extend around them) to provide an electrical side-wall boundary. The presence of grounded conductors on the lateral faces 98 of the substrate 30 electrically truncate the width (substantially) of the substrate 30.

The ground conductors 24 and 25 shown in FIG. 2 are electrically connected through the package base 52. However, the ground conductors 24 and 25 are optionally further electrically connected with crossover bonds (not shown) in order to ensure equal ground potentials on either side of the signal conductor 20 and suppress parasitic coupled slot-line modes.

In some embodiments of the CPW structure 200, the transverse dimensions of substrate 30 are chosen appropriately to prevent spurious modes in the frequency band of interest (i.e. the operational bandwidth) in operation. Supporting (suspending) the substrate 30 above the cavity 70 aides in suppressing and mitigating the undesired dominant microstrip-like mode(s) between the signal conductor 20 and the surface 56 of the package base 52.

The presence of the cavity 70 has the benefit of lowering the effective dielectric constant of the substrate 30, as the effective dielectric constant affects the electro-magnetic field emanating from the signal conductor 20. Lowering the effective dielectric constant of the substrate has the effect of pushing any parasitic transverse resonances and parasitic substrate modes out of the operational bandwidth by making the substrate width electrically smaller with respect to the guided wavelength of the fundamental mode.

Numerous modifications and treatments have been created that can be applied to the CPW structure 200 for connecting hybrid components and MMICs (Monolithic Microwave or Millimeter-wave Integrated Circuits). These modifications and packaging configurations are discussed in greater detail below. The various options for packaging a MMIC in combination with a STCPW line may be summarized into the following four scenarios based on the height of the MMIC $h_1$ and the height h of the substrate 30 above the flat surface 56 of the package base 52:

| | | | |
|---|---|---|---|
| Case (a): | STCPW with $h_1$ | >> | h |
| Case (b): | STCPW with $h_1$ | ≈ | h |
| Case (c): | STCPW with $h_1$ | < | h |
| Case (d): | STCPW with $h_1$ | > | h (a special case when transverse resonances are inherent to the MMIC and need extensive treatment during packaging) |

FIGS. 3–6 described below illustrate the above four scenarios of CPWs packaged with MMICs of different heights (or thickness). The height of the MMIC for the above definition can also include the height of any electrical insulator needed to electrically isolate the backside of the MMIC from the package base 52. The height of the MMIC includes the height of any electrical insulator to account for cases where the MMIC backside metallization requires a DC voltage on the backside metallization in operation and thus needs to be isolated from the package base 52.

Inductance of bond wires or conductive ribbons connecting the MMIC to the CPW Structure 200 has been identified as the single largest source of impedance mismatch that limits the bandwidth of operation of the MMIC in combination with the CPW structure 200. As such it is desirable to reduce the length of bond-wire or ribbon. One way to reduce the length of the bond-wire or ribbon is to align the surface of the MMIC to be substantially level with the signal conductor 20 on the CPW structure 200. To that end, a pedestal (not shown) underneath the MMIC can be added and tailored in height so that the wire-bond pads (not shown) on either side of MMIC and CPW structure 200 are aligned to be level and the span between the two minimized. The pedestal may possibly be directly integrated into the package base 52 or added as a separate component.

Conductive surfaces on the package base 52 are positioned appropriately or eliminated in areas along the CPW structure 200 or MMIC where there is a significant amount of transverse electric field present. If the conductive surfaces are not positioned appropriately or eliminated, spurious modes could resonate through multiple reflections between the conductive surfaces which could result in glitches or nulls in the transmission characteristic. In one embodiment, the ground conductors 24 and 25 also extend around to the bottom face of the substrate 30. In another embodiment, the package base 52 may be a ceramic or other dielectric material that has been coated with a conducting material (e.g. a metal).

Figure 3:
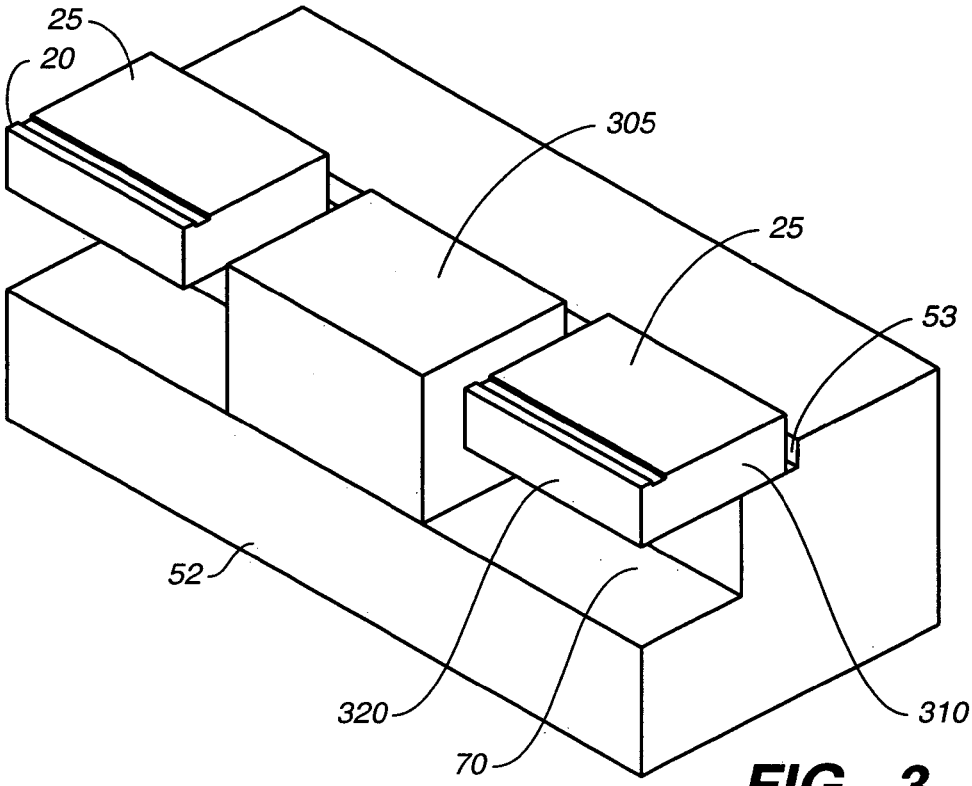
FIG. 3 is a cross-sectional view of a Coplanar Waveguide ("CPW") structure with a monolithic microwave or millimeter integrated circuit ("MMIC").

FIG. 3 shows an MMIC 305 packaged with a CPW on a common package base 52. As in the embodiment of FIG. 2, the CPW of FIG. 3 includes a signal conductor 20. In the scenario of FIG. 3, the MMIC 305 is thicker than the substrate 310. The cavity 70 is chosen so that the top of the substrate 310 is substantially flush with the top of the MMIC 305. As in the embodiment of FIG. 2, the substrate itself 310 has edge plating 25 in a wrap-around fashion that includes a narrow strip of metallization on the bottom side 320 to the extent that the bottom side 320 rests on the metal package ledge 53. Thus the substrate 52 has sidewalls that confine and bound the electromagnetic energy within the substrate 52.

In one implementation, the width of the substrate 52 is chosen such that the ground loop, consisting of the CPW ground conductors, the edge plating 25 and the walls of the package forming the cavity broken only at the CPW gaps on top of the substrate, is smaller than a quarter of the guide wavelength at the highest frequency of the data bandwidth. The MMIC 305 is attached to the package base 52 using either conductive or non-conductive adhesive based on the requirements of electrical isolation of the die backside.

Figure 4:
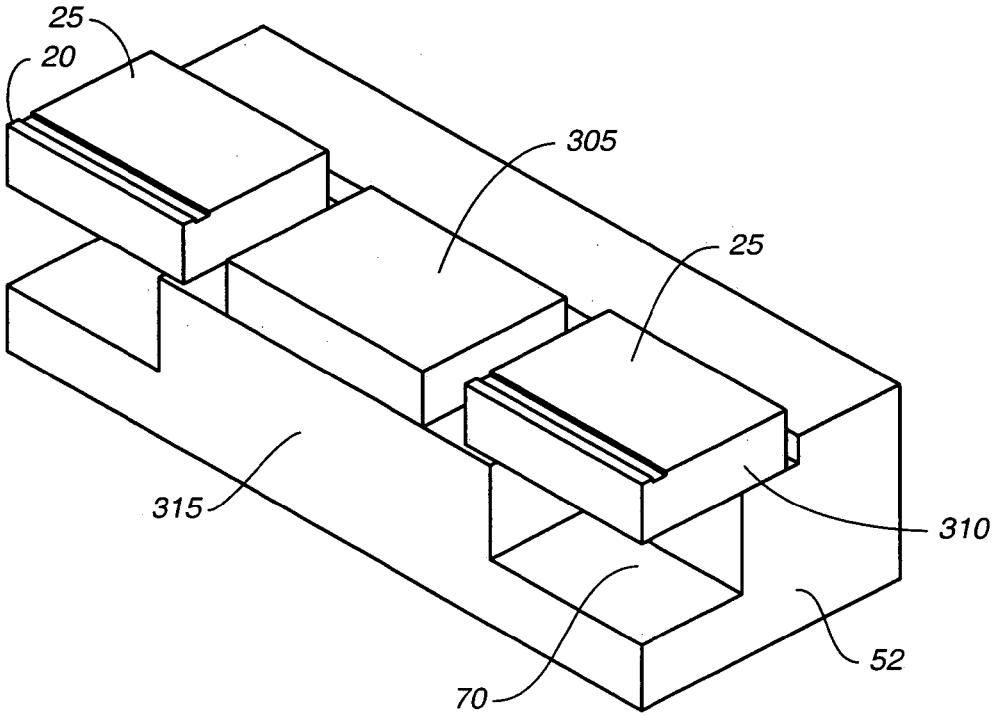
FIG. 4 is a cross sectional view of a CPW with a MMIC.

FIG. 4 shows a scenario of MMIC packaging where the MMIC 305 is substantially a same thickness as the CPW substrate 310. As in the embodiment of FIG. 2, the CPW of FIG. 4 includes a signal conductor 20 and a coplanar ground conductor 25. In the scenario of FIG. 4, the MMIC 305 is attached to a raised feature 315 in the package base 52, such as a pedestal or a Kovar tab. The raised feature 315 is chosen to be subsequently the same thickness as the depth of the cavity 70 underneath the substrate 310. The raised feature 315 ensures that the top surface of the substrate 310 and the MMIC 305 are substantially flush, requiring only a short wire or ribbon bond to connect them resulting in low inductance. Low inductance for the bonds results in good return loss of interconnect between substrate 30 or 310 and MMIC 305 which is a key requirement for maximum power transfer across the interconnect over a broad range of frequencies.

Figure 5:
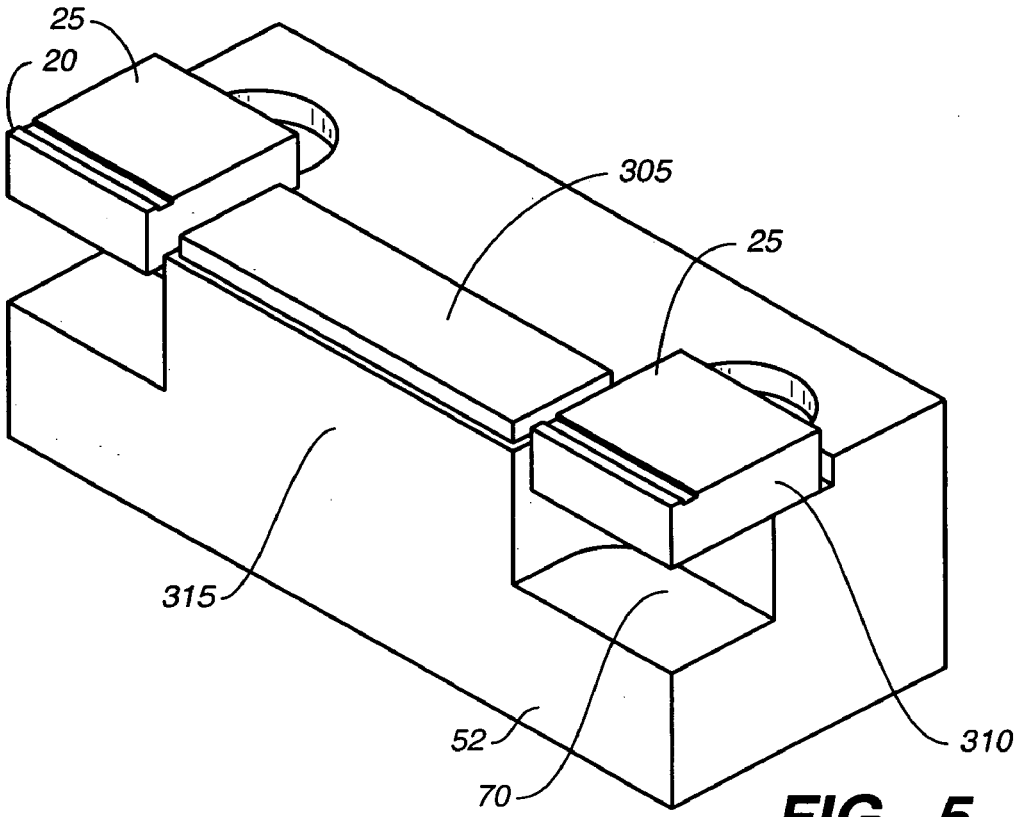
FIG. 5 is a cross sectional view of a CPW with a MMIC.

FIG. 5 shows a scenario of MMIC packaging where the MMIC 305 is much thinner than the CPW substrate 310. As in the embodiment of FIG. 2, the CPW of FIG. 5 includes a signal conductor 20, a coplanar ground conductor 25, a package base 52 and a cavity 70. In the scenario of FIG. 5, the MMIC 305 is attached to a raised feature 315 (e.g. pedestal) of appropriate thickness so that the top surface of the substrate 310 and the MMIC 305 are once again substantially flush. As before, alignment of the substrate 310 with the MMIC 305 allows a short low inductance interconnect with wire or ribbon. Keeping the bond inductance low result in a high performance interconnect for high frequency broadband applications.

Figure 6:
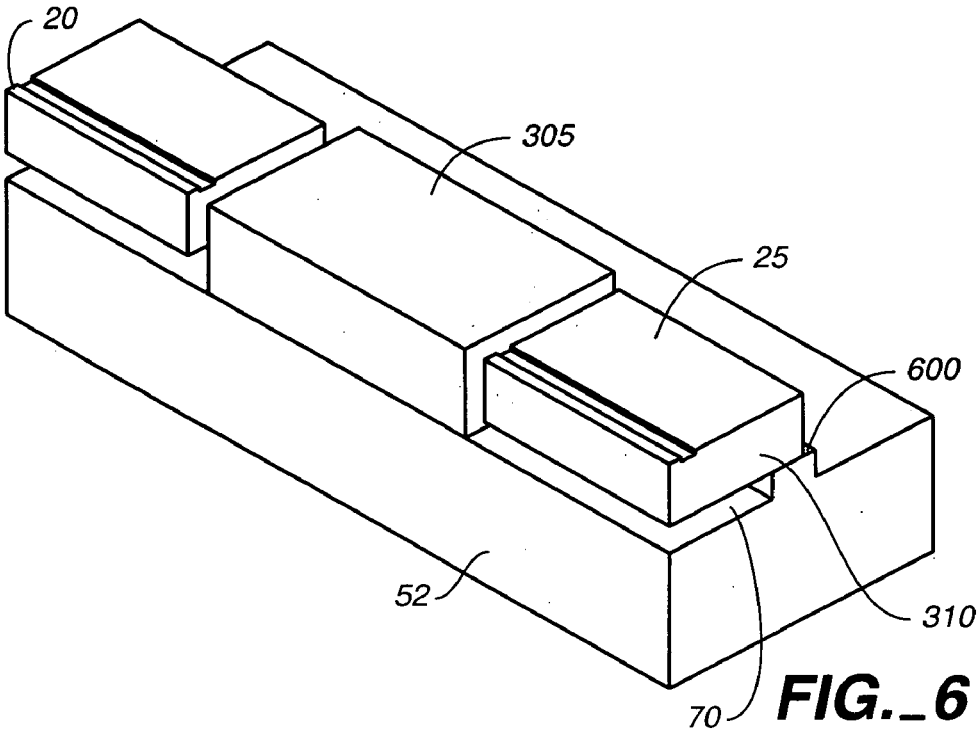
FIG. 6 is a cross sectional view of a CPW with an MMIC.

FIG. 6 shows a scenario of MMIC packaging where the thickness of the MMIC 305 is approximately equal to the ideal value of the depth of the cavity 70 plus the thickness of the CPW substrate 310. As in the embodiment of FIG. 2, the CPW of FIG. 6 includes a signal conductor 20 and a coplanar ground conductor 25. In such a case, the MMIC 305 may be attached to the flat surface of the package base 52. If not, the cavity depth is adjusted until the top surface of the MMIC 305 is substantially flush with that of the CPW substrate 310. The CPW substrate 310 may either be suspended on a cavity 70 and attached to a ledge, e.g., feature 53 in FIG. 3, with sidewalls that confine and align the CPW substrate 310. Alternatively, the CPW substrate 310 can be attached on raised ribs 600 running underneath the substrate forming a cavity 70 between a pair of ribs. The latter approach is chosen in situations when the MMIC 305 displays strong transverse resonances due to the proximity of the reflecting metal walls that the form the sidewall of the substrate. Incorporating the cavity 70 for the CPW substrate 310 between raised ribs 600 instead of a ledge and cavity suspension approach eliminates the need for all metal walls at the MMIC and eliminates or mitigates most unwanted resonances.

Figure 7:
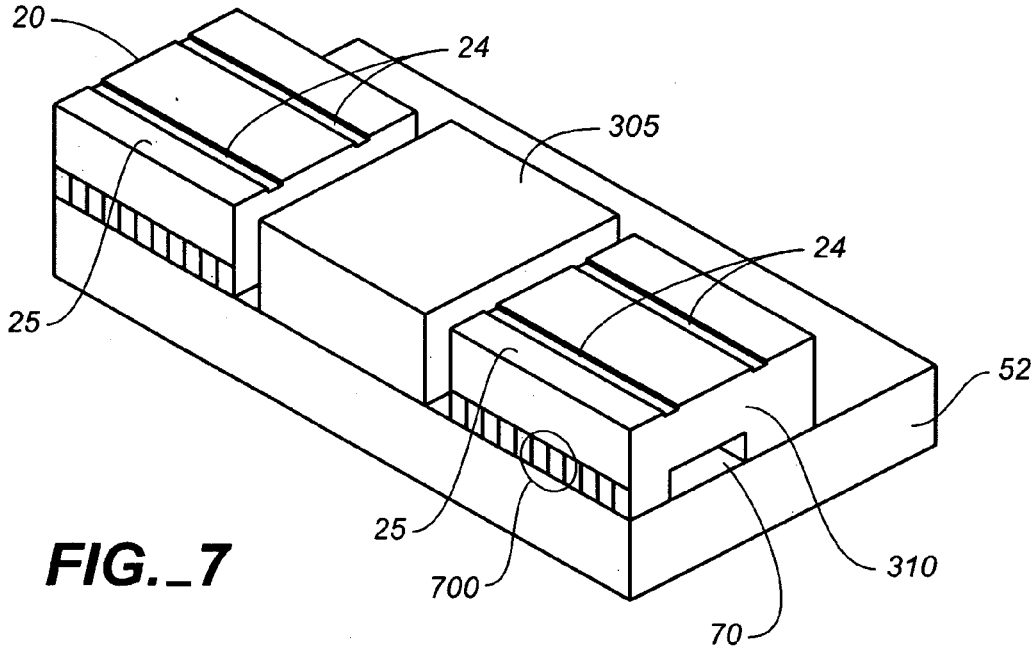
FIG. 7 is a cross sectional view of a CPW with a MMIC showing a plurality of conductive ribs in the base of the CPW.

FIG. 7 shows an MMIC 305 packaged with a CPW substrate 310 where the lateral face of the ground conductor 25 is electrically coupled to the base 52 by a plurality of conductive ribs 700. As in the case of the embodiment of FIG. 2, the CPW also includes a signal conductor 20, an additional around conductor 24, and a cavity 70. The configuration of FIG. 7 also exhibits the advantageous resonance suppression discussed above with respect to FIG. 6.

In addition to the variations illustrated above many of the distinguishing features of STCPW structures are possible in an asymmetric version of the CPW structure 200 that is otherwise implicitly symmetric. Referring again to FIG. 2, the difference between an asymmetric CPW and symmetric CPW transmission line is that the respective spacings $s_1$ and $s_2$ between the signal conductor and each of the two ground conductors are equal for a so-called symmetric CPW structure and unequal on an asymmetric CPW structure.

Figure 8:
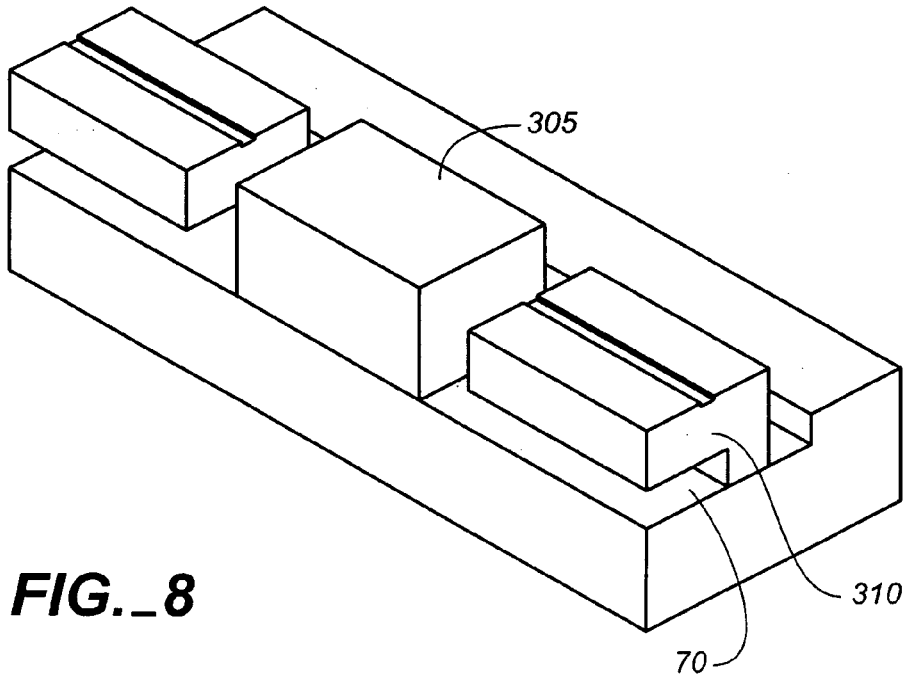
FIG. 8 is a cross sectional view of a CPW with a ceramic base during fabrication.

Embodiments are compatible with advances in high density packaging techniques. For example, FIG. 8 shows an MMIC 305 packaged with a CPW substrate 310 suspended above an cavity 70. Using a HTCC or LTCC multilayered ceramic can enable forming the cavity 70 within the bottom layer of the ceramic layers by punching out the cavity 70 when the ceramic is still in a paste or "green state" and then cofiring with the other layers to result in the structure of FIG. 7.

What has been described is merely illustrative of the application of the principles of the invention. Other arrangements and methods can be implemented by those skilled in the art without departing from the spirit and scope of the present invention.

Figure 9:
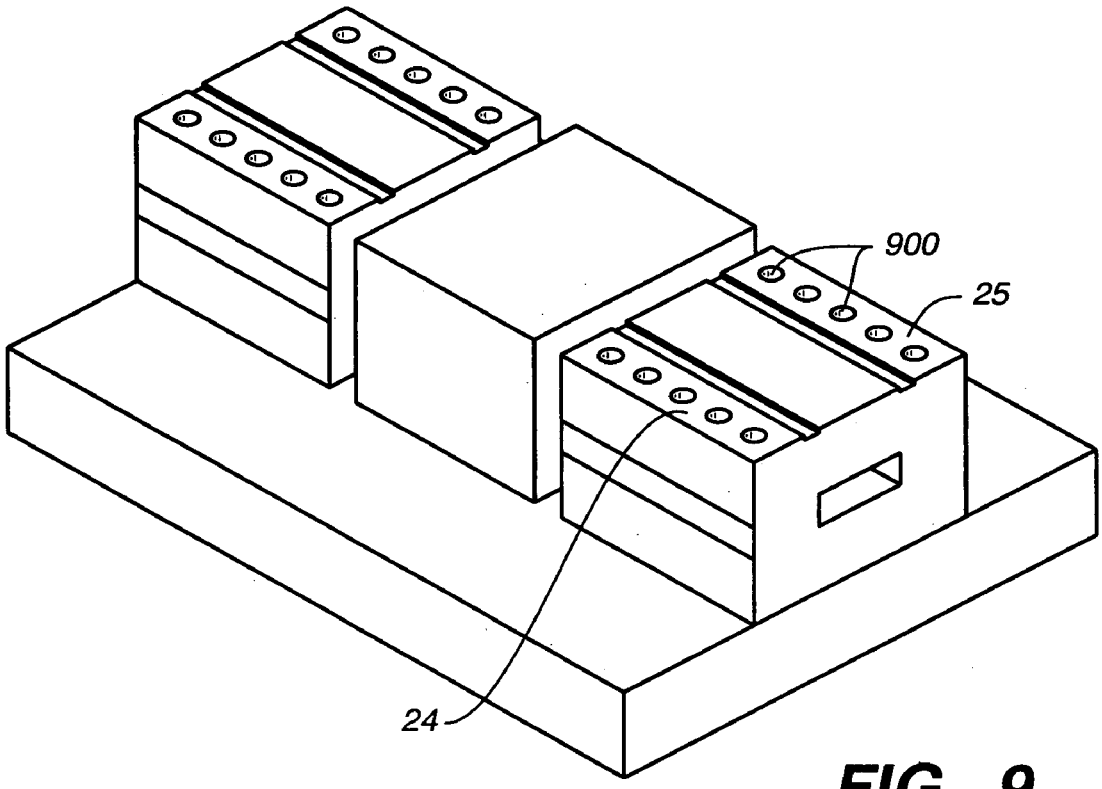
FIG. 9 is a cross sectional view of a CPW with a MMIC showing a plurality of conductive vias.

A number of embodiments have been described. Nevertheless, it will be understood that various modifications may be made without departing from the spirit and scope of the invention. For example, FIG. 9 shows a multi-layer suspended CPW where the electrical side wall boundary function is performed by a plurality of conductive vias 900 connecting the co-planar ground conductors 24, 25 to a lower plane ground conductor (not shown). Such a structure is suitable for use in an environment where a ceramic substrate is employed for packaging multiple MMICs for a tighter level of integration.

In other embodiments, other packaging elements like three-dimensional interconnects, for example a coaxial to CPW orthogonal interconnect, can be enabled by using multi-layer cofired ceramic technology.

Other embodiments are within the scope of the following claims.

What is claimed is:

1. A transmission medium for use in broadband applications, the transmission medium comprising:

a substrate having a substantially flat top surface and two lateral faces;

a signal conductor and two ground conductors placed on the top surface of the substrate forming a ground-signal-ground pattern along a common plane, wherein each ground conductor extends to a respective edge of the top surface of the substrate and wraps around to a corresponding lateral face of the substrate; and a base.

2. The transmission medium of claim 1 wherein the base defines a cavity underneath substantially an entire length of the substrate.

3. The transmission medium of claim 2 wherein the cavity defined by the base is filled with a dielectric material.

4. The transmission medium of claim 2 wherein the cavity defined by the base is air filled.

5. The transmission medium of claim 1 wherein the base provides a common ground potential that is coupled to the two ground conductors.

6. The transmission medium of claim 1 further comprising a Monolithic Integrated Circuit.

7. The transmission medium of claim 6 wherein the Monolithic Integrated Circuit comprises a top surface and wherein the Monolithic Integrated Circuit is arranged such that the top surface is approximately coplanar with the top surface thereof of the substrate.

8. A method of fabricating a transmission medium for use in broadband applications comprising the steps of:

providing a pre-fired ceramic base;

providing a co-planar waveguide having a signal conductor and two ground conductors;

arranging the co-planar waveguide on the base;

removing base material from underneath the co-planar waveguide thereby making a cavity; and co-firing at least the base and the co-planar waveguide.

9. A transmission medium for use in broadband applications, the transmission medium comprising:

a substrate having a substantially flat top surface and two lateral faces;

a signal conductor and two ground conductors placed on the top surface of the substrate thereby producing a ground-signal-ground pattern along a common plane, wherein each ground conductor extends to a respective edge of the top surface of the substrate;

a respective electrical side-wall boundary on each of the two lateral faces of the substrate; and a base, wherein the base defines a cavity filled with a dielectric material underneath substantially an entire length of the substrate.

10. A transmission medium for use in broadband applications, the transmission medium comprising:

a substrate having a substantially flat top surface and two lateral faces;

a signal conductor and two ground conductors placed on the top surface of the substrate thereby producing a ground-signal-ground pattern along a common plane, wherein each ground conductor extends to a respective edge of the top surface of the substrate;

a respective electrical side-wall boundary on each of the two lateral faces of the substrate; and a base, wherein the electrical side-wail boundaries comprise a plurality of conductive ribs electrically connecting the top surface of the substrate to the base.

11. The transmission medium of claim 10 wherein the base defines a cavity underneath substantially an entire length of the substrate.

12. The transmission medium of claim 11 wherein the cavity defined by the base is filled with a dielectric material.

13. The transmission medium of claim 11 wherein the cavity defined by the base is air filled.

14. The transmission medium of claim 10 wherein the base provides a common ground potential that is coupled to the two ground conductors and each of the two electrical side-wall boundaries.

15. The transmission medium of claim 10 further comprising a Monolithic Integrated Circuit.

16. The transmission medium of claim 15 wherein the Monolithic Integrated Circuit comprises a top surface and wherein the Monolithic Integrated Circuit is arranged such that the top surface is approximately coplanar with the top surface thereof of the substrate.

17. A transmission medium for use in broadband applications, the transmission medium comprising:

a substrate having a substantially flat top surface and two lateral faces;

a signal conductor and two ground conductors placed on the top surface of the substrate thereby producing a ground-signal-ground pattern along a common plane, wherein each ground conductor extends to a respective edge of the top surface of the substrate;

a respective electrical side-wall boundary on each of the two lateral faces of the substrate; and a base, wherein the electrical side-wall boundaries comprise a plurality of conductive vias connecting the top surface of the substrate to the base.

18. The transmission medium of claim 17 wherein the base defines a cavity underneath substantially an entire length of the substrate.

19. The transmission medium of claim 18 wherein the cavity defined by the base is filled with a dielectric material.

20. The transmission medium of claim 18 wherein the cavity defined by the base is air filled.

21. The transmission medium of claim 17 further comprising a Monolithic Integrated Circuit.

22. The transmission medium of claim 21 wherein the Monolithic Integrated Circuit comprises a top surface and wherein the Monolithic Integrated Circuit is arranged such that the top surface is approximately coplanar with the top surface thereof of the substrate.

23. The transmission medium of claim 17 wherein the base provides a common ground potential that is coupled to the two ground conductors and each of the two electrical side-wall boundaries.

* * * * *